US011655532B2

(12) United States Patent
Terasaki et al.

(10) Patent No.: US 11,655,532 B2
(45) Date of Patent: May 23, 2023

(54) GAS WIPING NOZZLE AND METHOD OF MANUFACTURING HOT-DIP METAL COATED METAL STRIP

(71) Applicant: JFE Steel Corporation, Tokyo (JP)

(72) Inventors: Yu Terasaki, Tokyo (JP); Hideyuki Takahashi, Tokyo (JP); Kenji Yamashiro, Tokyo (JP); Takumi Koyama, Tokyo (JP); Yoshihiko Kaku, Tokyo (JP); Kenji Tsuboi, Tokyo (JP); Hidetoshi Inoue, Tokyo (JP); Syuhei Nishinaka, Tokyo (JP); Toshiki Fujii, Tokyo (JP); Reona Aishima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 8 days.

(21) Appl. No.: 17/434,026

(22) PCT Filed: Oct. 29, 2019

(86) PCT No.: PCT/JP2019/042428
§ 371 (c)(1),
(2) Date: Aug. 26, 2021

(87) PCT Pub. No.: WO2020/174750
PCT Pub. Date: Sep. 3, 2020

(65) Prior Publication Data

US 2022/0136090 A1 May 5, 2022

(30) Foreign Application Priority Data

Feb. 26, 2019 (JP) ..... JP2019-033078

(51) Int. Cl.
*C23C 2/20* (2006.01)
*C23C 2/00* (2006.01)
(Continued)

(52) U.S. Cl.
CPC ..... *C23C 2/20* (2013.01); *B05C 5/027* (2013.01); *B24C 5/04* (2013.01); *C23C 2/003* (2013.01); *C23C 2/16* (2013.01)

(58) Field of Classification Search
CPC .. C23C 2/20; C23C 2/003; B24C 5/04; B05C 5/0254; B05C 5/027
See application file for complete search history.

(56) References Cited

U.S. PATENT DOCUMENTS 5,066,519 A * 11/1991 Robertson ..... C23C 2/18 427/349
6,319,316 B1 * 11/2001 Gibson ..... B05C 5/0254 118/410

(Continued)

FOREIGN PATENT DOCUMENTS

JP H01-147252 U 10/1989
JP H08-176776 A 7/1996

(Continued)

OTHER PUBLICATIONS

Engineering ToolBox, (2003). Thermal Expansion—Linear Expansion Coefficients, [online] Available at: https://www.engineeringtoolbox.com/linear-expansion-coefficients-d_95.html, pp. 1, 3 (Year: 2023).*

(Continued)

*Primary Examiner* — Karl Kurple
(74) *Attorney, Agent, or Firm* — DLA Piper LLP (US)

(57) ABSTRACT

A gas wiping nozzle configured to blow wiping gas onto a metal strip includes a first nozzle member and a second nozzle member provided to face each other, in which a slit as a gas blowing port is formed to extend in a length direction between end portions of the first nozzle member and the second nozzle member on the metal strip side; and a shim member configured to adjust a gap of the slit in a (Continued)

width direction orthogonal to the length direction, wherein the shim member is made of a ceramic material or a carbon material, each of the first nozzle member and the second nozzle member has a groove portion, and the shim member is fitted into both of the groove portions of the first nozzle member and the second nozzle member and fixes the first nozzle member and the second nozzle member.

14 Claims, 6 Drawing Sheets

(51) Int. Cl.

| | |
|---|---|
| ***C23C 2/16*** | (2006.01) |
| ***B24C 5/04*** | (2006.01) |
| ***B05C 5/02*** | (2006.01) |

(56) References Cited

U.S. PATENT DOCUMENTS

| | | | | |
|---|---|---|---|---|
| 7,021,019 | B2 * | 4/2006 | Knauseder | E04F 15/04 24/297 |
| 10,232,399 | B2 * | 3/2019 | Choi | B05C 5/005 |
| 10,835,917 | B2 * | 11/2020 | Yamane | B05C 5/0254 |
| 2003/0192955 | A1 * | 10/2003 | Geskin | B05B 1/04 239/555 |
| 2006/0156642 | A1 * | 7/2006 | Terzi | E04H 4/0031 52/79.1 |
| 2012/0260602 | A1 * | 10/2012 | Baker | E04F 15/04 52/745.19 |
| 2014/0131464 | A1 * | 5/2014 | Nagata | B05C 1/027 239/597 |
| 2020/0171513 | A1 * | 6/2020 | Nishimura | C23C 2/003 |

FOREIGN PATENT DOCUMENTS

| | | | |
|---|---|---|---|
| JP | 2007-270161 | A | 10/2007 |
| JP | 6011740 | B | 10/2016 |
| JP | 2018-178159 | A | 11/2018 |
| WO | 2016/056178 | A1 | 4/2016 |

OTHER PUBLICATIONS

Steel-Grades, "SCM3", 2023, https://www.steel-grades.com/Metals/85/211561/-SCM-3.pdf (Year: 2023).*

Anson Steel, "Alloy Steel Comparison", http://www.ansonsteels.com/ComparisionStandard/Alloy-Steel-Comparision.pdf (Year: 2023).*

MatWeb, "AISI 4137H Steel", https://www.matweb.com/search/DataSheet.aspx?MatGUID=72fb949de7a6408587014a5e729d4640 (Year: 2023).*

* cited by examiner

GAS WIPING NOZZLE AND METHOD OF MANUFACTURING HOT-DIP METAL COATED METAL STRIP

TECHNICAL FIELD

This disclosure relates to a gas wiping nozzle that blows gas onto a metal strip pulled up from a molten metal bath and adjusts the amount of a molten metal coated to a surface of the metal strip and a method of manufacturing a hot-dip metal coated metal strip using the gas wiping nozzle.

BACKGROUND

A hot-dip galvanized steel sheet, which is a type of hot-dip metal coated steel sheets, is widely used in fields such as building materials, automobiles, and home appliances. In those applications, an excellent appearance is required for the hot-dip galvanized steel sheet. Since the appearance after painting is strongly affected by surface defects such as uneven coating thickness, flaws, and adhesion of foreign matter, it is important that the hot-dip galvanized steel sheet has no surface defects.

In a continuous hot-dip metal coating line, normally, a steel strip as a metal strip annealed in a continuous annealing furnace in a reducing atmosphere passes through a snout and is introduced into a molten metal bath in a coating tank. The steel strip is pulled up above the molten metal bath via a sink roll and a support roll in the molten metal bath. Thereafter, the amount (also referred to as a basic weight amount) of molten metal coated is adjusted by blowing wiping gas from gas wiping nozzles located on both sides of the steel strip onto the surface of the steel strip and scraping off the excess molten metal coated to the surface of the steel strip and pulled up. To correspond to various steel strip widths and also cope with displacement in the width direction when the steel strip is pulled up, the gas wiping nozzle is normally configured to be wider than the width of the steel strip and extends outward from an end portion in the width direction of the steel strip.

In such a gas wiping method, hot metal wrinkles (also referred to as hot metal sagging) with corrugated flow pattern are often generated on the coated surface due to minute vibration of the steel strip or irregular hot metal flow on the coating layer due to the blowing of wiping gas. When the coated surface of a coated steel sheet with such hot metal wrinkles is used as a coating base surface in an outer coating application, a surface texture of a coating film, particularly smoothness, is impaired, and thus the coated steel sheet cannot be used for an exterior sheet to be suitable for a coating treatment having an excellent appearance, which significantly affects the yield of the coated steel sheet.

To solve this problem, for example, those described in Japanese Patent No. 6011740 are known.

A continuous hot-dip metal coating method described in JP '740 is a method in which a steel strip is continuously immersed in a molten metal coating bath, and gas is blown from a gas wiping nozzle onto the steel strip immediately after being drawn out from the molten metal coating bath to control the amount of coating. The temperature T of the wiping gas blown from the gas wiping nozzle is controlled according to a DB value represented by a ratio of the distance D between a tip end of the gas wiping nozzle and the steel strip, and a gas wiping nozzle gap B.

In addition, in the known gas wiping method, a phenomenon that the edge portion of the steel strip may be supercooled from a central portion occurs during wiping, the steel strip may be warped, the amount of coating in the width direction may be uneven, and there may also be a problem of wasting a large amount of zinc in vain to guarantee the lower limit of the amount of zinc coated.

To solve this problem, for example, a method described in JP H08-176776 A is known.

A wiping method in continuous hot-dip galvanizing described in JP '776 is a method of heating wiping gas such that the temperature $T_G$ (° C.) of the wiping gas and the sheet thickness D (mm) of a steel strip to be coated satisfy equation (1), in the continuous hot-dip galvanizing, when the wiping gas is blown from a gas wiping nozzle to wipe the hot-dip zinc coating to the front and rear of the steel strip to be coated:

$$\text{Wiping gas temperature } T_G\ (^\circ\text{C.}) \geq -400D+400 \quad (1).$$

In addition, as the gas wiping nozzle, for example, a nozzle described in JP 2018-178159 A is also known.

The gas wiping nozzle described in JP '159 is a nozzle that blows gas onto a steel strip pulled up above a molten metal coating bath and adjusts a film thickness of a molten metal film coated to the surface of the steel strip. The gas wiping nozzle includes a first lip portion and a second lip portion that are provided to face each other and form a nozzle chamber into which gas is introduced, a slit formed between the end portions of the first lip portion and the second lip portion on the steel strip side, as a blowing port for gas blown from the nozzle chamber, and a fixing member provided on the slit side in the nozzle chamber and fixing the first lip portion and the second lip portion. In the fixing member, a plurality of first communication holes that communicate the slit side and the opposite side of the slit with respect to the fixing member is disposed side by side along the width direction of the steel strip.

According to the gas wiping nozzle described in JP '159, even when each part is reassembled to replace a part or all of the parts constituting the gas wiping nozzle, it is possible to suppress variations in a gap of the slit (also referred to as a slit gap) after assembly for each assembly.

However, the continuous hot-dip metal coating method described in JP '740, the wiping method in the continuous hot-dip galvanizing described in JP '776, and the gas wiping nozzle described in JP '159 in the related art have the following problems.

That is, in the continuous hot-dip metal coating method described in JP '740 and the wiping method in continuous hot-dip galvanizing described in JP '776, the wiping gas is heated to create a high temperature atmosphere around the gas wiping nozzle, and the gas wiping nozzle itself is also heated as the wiping gas is heated. The material of the gas wiping nozzle is not described in JP '740 and JP '776, and when the gas wiping nozzle is made of metal according to a normal method, the nozzle is significantly deformed due to the property of being easily plastically deformed or the property of having a high coefficient of linear expansion. As a result, there is a problem that a gap of a slit as a gas blowing port provided at the end portion of the gas wiping nozzle on the steel strip side, that is, the gap in the width direction orthogonal to the length direction of the slit cannot be uniformly held along the length direction of the slit, and the amount of coating to the steel strip along the width direction of the steel strip is non-uniform.

On the other hand, in the gas wiping nozzle described in JP '159, since the first lip portion and the second lip portion are fixed on the slit side in the nozzle chamber by the fixing member, it is possible to suppress variations in the slit gap after assembly for each assembly when replacing a part or all of the parts constituting the gas wiping nozzle.

However, since the fixing member in the gas wiping nozzle described in JP '159 and the bolt used to fix the fixing member are made of metal, there is a problem that the fixing member, the bolt or the like extends in a high temperature atmosphere, which changes the slit gap, and the gap of the slit cannot be uniformly held along the length direction of the slit.

Therefore, it could be helpful to provide a gas wiping nozzle capable of uniformly holding a gap in the width direction orthogonal to the length direction of a slit as a gas blowing port along the length direction of the slit even in a high temperature atmosphere, and a method of manufacturing a hot-dip metal coated metal strip using the gas wiping nozzle.

SUMMARY

We thus provide a gas wiping nozzle configured to blow wiping gas onto a metal strip pulled up from a molten metal bath and adjust an amount of a molten metal coated to a surface of the metal strip, the gas wiping nozzle including: a first nozzle member and a second nozzle member provided to face each other, in which a slit as a gas blowing port is formed to extend in a length direction between end portions of the first nozzle member and the second nozzle member on the metal strip side; and a shim member configured to adjust a gap of the slit in a width direction orthogonal to the length direction, in which the shim member is made of a ceramic material or a carbon material, each of the first nozzle member and the second nozzle member has a groove portion, and the shim member is fitted into both of the groove portions of the first nozzle member and the second nozzle member and fixes the first nozzle member and the second nozzle member.

We also provide a method of manufacturing a hot-dip metal coated metal strip, the method including: disposing a pair of the gas wiping nozzles described above on both surface sides of a metal strip pulled up from a molten metal bath; blowing wiping gas from each slit of the pair of gas wiping nozzles to each surface of the metal strip to adjust an amount of molten metal coated to both surfaces of the metal strip; and continuously manufacturing a hot-dip metal coated metal strip.

According to our gas wiping nozzle and the method of manufacturing the hot-dip metal coated metal strip, it is possible to provide the gas wiping nozzle capable of uniformly holding the gap in the width direction orthogonal to the length direction of the slit as the gas blowing port along the length direction of the slit even in a high temperature atmosphere, and the method of manufacturing the hot-dip metal coated metal strip using the gas wiping nozzle.

REFERENCE SIGNS LIST

Figure 1:
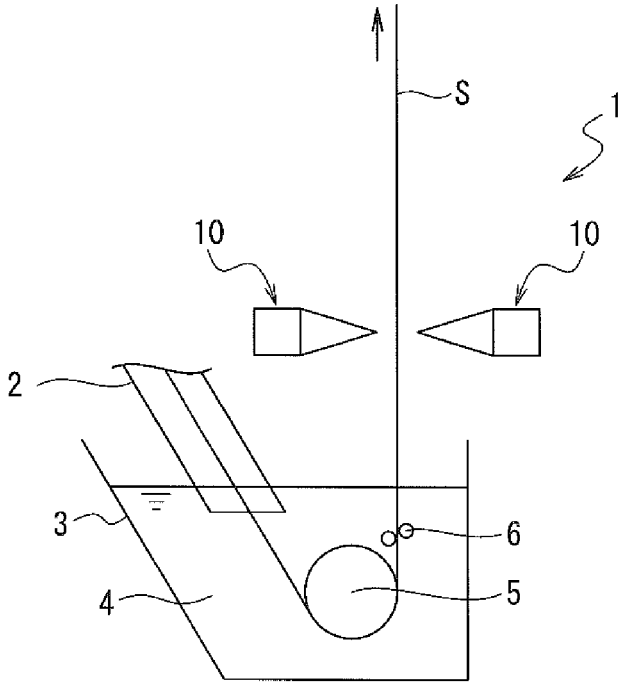
FIG. 1 is a schematic view illustrating a schematic configuration of continuous hot-dip metal coating equipment provided with a gas wiping nozzle according to an example.

1 continuous hot-dip metal coating equipment
2 snout
3 coating tank
4 molten metal bath
5 sink roll
6 support roll
10 gas wiping nozzle
11 first nozzle member
11*a* front end surface
11*b* rear end surface
11*c* end portion
11*d* side surface
12 second nozzle member
12*a* front end surface
12*b* rear end surface
12*c* end portion
12*d* side surface
13 hollow portion
13*a* hollow portion forming space
13*b* hollow portion forming space
13*c* hollow portion forming space
14 slit
15 nozzle header
16 gas supply path
17 gas supply pipe
21 groove portion of first nozzle member
21*a* linear portion
21*b* dovetail-shaped portion
21*c* corner portion
22 groove portion of second nozzle member
22*a* linear portion
22*b* dovetail-shaped portion
22*c* corner portion
23 mating surface
30 shim member
31 first fitting portion
31*a* inclined surface
32 second fitting portion
32*a* inclined surface
41 groove portion of first nozzle member
41*a* first linear portion
41*b* second linear portion

41*c* corner portion
42 groove portion of second nozzle member
42*a* first linear portion
42*b* second linear portion
42*c* corner portion
50 shim member
51 first fitting portion
51*a* lower surface
52 second fitting portion
52*a* upper surface
61 groove portion of first nozzle member
61*a* corner portion
62 groove portion of second nozzle member
62*a* corner portion
70 shim member
71 pin
81 groove portion of first nozzle member
82 groove portion of second nozzle member
90 shim member
91 metal bolt
L1 slit length
L2 slit depth
L3 slit width (gap of slit)
S steel strip (metal strip)
X length direction of slit (width direction of steel strip)
Y depth direction of slit (sheet thickness direction of steel strip)
Z width direction of slit (sheet length direction of steel strip)

DETAILED DESCRIPTION

Hereinafter, examples of our nozzles and methods will be now described with reference to the drawings. The examples illustrated below represent devices and methods embodying our technical ideas, and the technical ideas do not specify the material, shape, structure, arrangement, and the like of the component parts in the following examples.

In addition, the drawings are schematic. Therefore, a relationship, ratio and the like between a thickness and a plane dimension are different from the actual ones, and there are parts where the relationship and ratio of the dimensions are different between the drawings.

FIG. 1 illustrates a schematic configuration of continuous hot-dip metal coating equipment provided with a gas wiping nozzle according to an example.

The continuous hot-dip metal coating equipment 1 illustrated in FIG. 1 is equipment that continuously coats molten metal to the surface of a steel strip S as a metal strip by immersing the steel strip S in a molten metal bath 4 made of the molten metal, and then bringing the molten metal into a predetermined amount of coating.

The continuous hot-dip metal coating equipment 1 includes a snout 2, a coating tank 3, a sink roll 5, and a support roll 6.

The snout 2 is a member having a rectangular cross section perpendicular to the traveling direction of the steel strip S, which partitions a space through which the steel strip S passes. The upper end of the snout 2 is connected to, for example, the outlet side of a continuous annealing furnace, and the lower end is immersed in the molten metal bath 4 stored in the coating tank 3. The steel strip S annealed in the continuous annealing furnace in a reducing atmosphere passes through the snout 2 and is continuously introduced into the molten metal bath 4 in the coating tank 3. Thereafter, the steel strip S is pulled upward from the molten metal bath 4 via the sink roll 5 and the support roll 6 in the molten metal bath 4.

Wiping gas is blown onto both surfaces of the steel strip S pulled upward from the molten metal bath 4 from a pair of gas wiping nozzles 10 (slits 14 described later) disposed on both surface sides of the steel strip S and the amount of molten metal coated to both surfaces of the steel strip S is adjusted. Thereafter, the steel strip S is cooled by cooling equipment (not illustrated) and guided to a subsequent step, and the hot-dip metal coated steel strip S is continuously manufactured.

Figure 2:
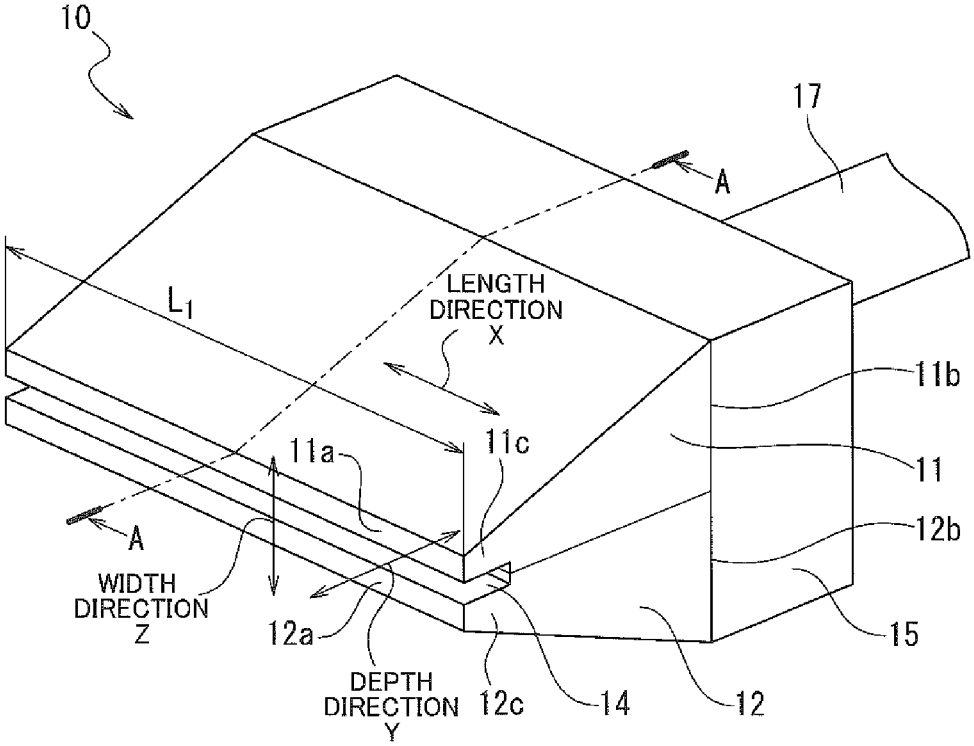
FIG. 2 is a perspective view illustrating a schematic configuration of the gas wiping nozzle used in the continuous hot-dip metal coating equipment illustrated in FIG. 1.

Each of the pair of gas wiping nozzles 10 disposed on both surface sides of the steel strip S includes a nozzle header 15 and a first nozzle member 11 disposed on the upper side and a second nozzle member 12 disposed on the lower side that are connected to the nozzle header 15 as illustrated in FIG. 2. The first nozzle member 11 and the second nozzle member 12 are provided to face each other, and the slit 14 as a gas blowing port is formed to extend elongated in the length direction X between the end portions 11*c* and 12*c*, on the steel strip S side, of the first nozzle member 11 and the second nozzle member 12. Each gas wiping nozzle 10 is disposed on each surface side of the steel strip S so that the length direction X of the slit 14 is along the sheet width direction of the steel strip S, the width direction Z orthogonal to the length direction X of the slit 14 is along the sheet length direction of the steel strip S, and the depth direction Y of the slit 14 is along the sheet thickness direction of the steel strip S. The width direction Z of the slit is the same as the vertical direction of the gas wiping nozzle 10. The wiping gas is blown from the slit 14 toward one surface of the steel strip S from one of the gas wiping nozzles 10. In addition, the wiping gas is blown from the slit 14 toward the other surface of the steel strip S from the other gas wiping nozzle 10. As a result, excess molten metal is scraped off on both surfaces of the steel strip S, the amount of coating (molten metal) is adjusted, and the amount of coating is made uniform in the sheet width direction and the sheet length direction of the steel strip S. To correspond to various sheet widths of steel strip S and cope with displacement in the width direction when the steel strip S is pulled up, each gas wiping nozzle 10 is configured to be longer than the sheet width of steel strip S so that the length of the slit 14 is longer than the sheet width of steel strip S, and extends outward from an end portion of the steel strip S in the width direction.

Figure 3:
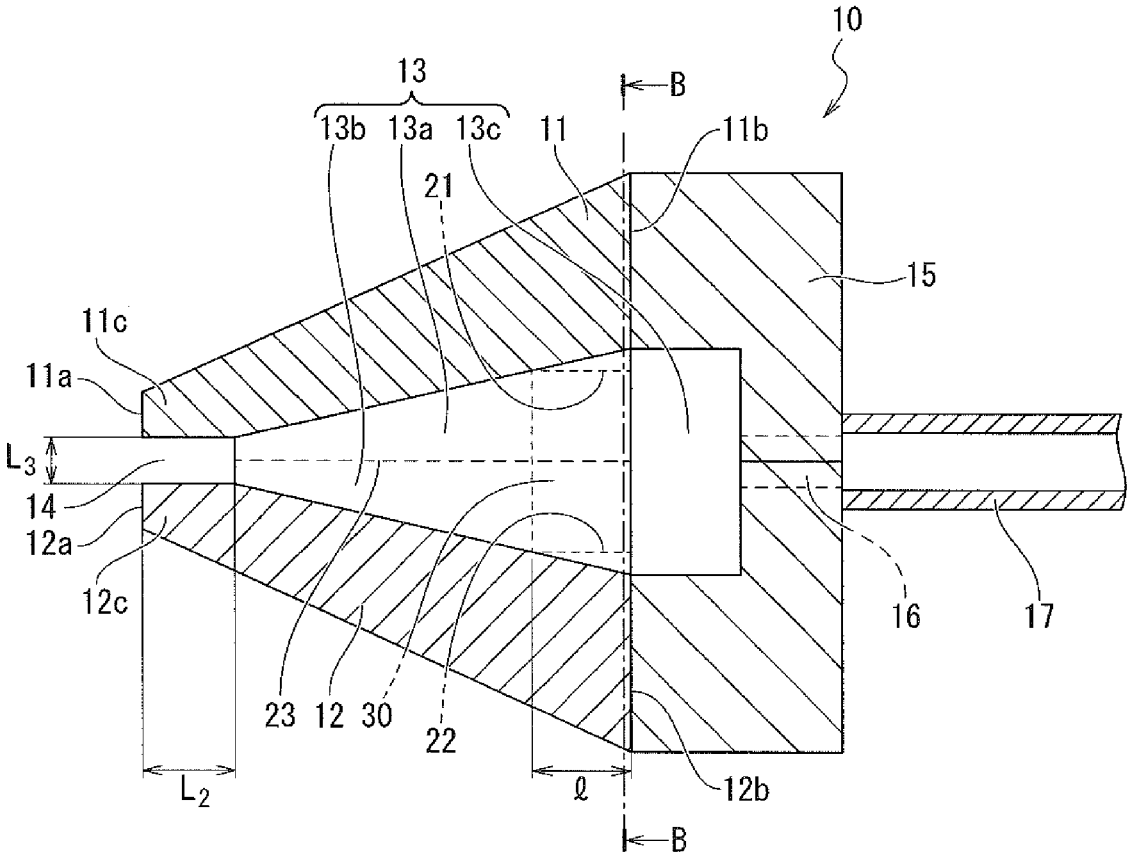
FIG. 3 is a cross-sectional view taken along line A-A in FIG. 2.

The nozzle header 15 of each gas wiping nozzle 10 is formed in a substantially rectangular shape extending in the length direction X, the depth direction Y, and the width direction Z, and the material thereof is a metal such as chrome molybdenum steel, for example. As illustrated in FIG. 3, the nozzle header 15 is formed so that a hollow portion forming space 13*c* constituting a hollow portion 13 described later opens on the front surface thereof (left surface in FIG. 3). A gas supply pipe 17 is connected to the base end portion (rear end portion) of the nozzle header 15, and a gas supply path 16 that connects the gas supply pipe 17 and the hollow portion forming space 13*c* is formed in the base end portion of the nozzle header 15.

In addition, as illustrated in FIGS. 2 and 3, the sheet thickness of the first nozzle member 11 disposed on the upper side gradually decreases from a rear end surface 11*b* toward a front end surface 11*a*, and the first nozzle member 11 is formed in a rectangular shape extending in the length direction X and the depth direction Y when viewed from above (upper side in FIG. 3). On the lower surface of the first nozzle member 11, a hollow portion forming space 13*a* constituting the hollow portion 13 described later is formed to taper from the rear side to the front side.

In addition, as illustrated in FIGS. 2 and 3, the sheet thickness of the second nozzle member 12 disposed on the lower side gradually decreases from a rear end surface 12*b* toward a front end surface 12*a*, and the second nozzle member 12 is formed in a rectangular shape extending in the length direction X and the depth direction Y when viewed from below (lower side in FIG. 3). On the upper surface of the second nozzle member 12, a hollow portion forming space 13*b* constituting the hollow portion 13 described later is formed to taper from the rear side to the front side.

The first nozzle member 11 and the second nozzle member 12 are vertically aligned and fixed, and each of the rear end surface 11*b* of the first nozzle member 11 and the rear end surface 12*b* of the second nozzle member 12 is connected to the front surface of the nozzle header 15. As a result, the hollow portion 13 is formed to include the hollow portion forming space 13*c* formed in the nozzle header 15, the hollow portion forming space 13*a* formed in the first nozzle member 11, and the hollow portion forming space 13*b* formed in the second nozzle member 12. The lower surface of the end portion 11*c* of the first nozzle member 11 on the steel strip S side and the upper surface of the end portion 12*c* of the second nozzle member 12 on the steel strip S side are opposite planes, and the space between these planes is the slit 14 as the gas blowing port described above. As described above, the slit 14 is elongated in the length direction X, the length of the length direction X is $L_1$ as shown in FIG. 2, the width in the width direction Z orthogonal to the length direction X, that is, the gap is $L_3$ as shown in FIG. 3, and the depth of the depth direction Y orthogonal to the length direction X is $L_2$ as shown in FIG. 3. Although the size of the slit 14 is not particularly limited, the length $L_1$ of the slit 14 is set with a margin according to the width of the steel strip S, and can be set to, for example, approximately 1500 to 2500 mm. In addition, the gap $L_3$ of the slit 14 can be set to, for example, approximately 0.5 to 3.0 mm. Furthermore, the depth $L_2$ of the slit 14 can be set to, for example, approximately 5 to 30 mm.

The slit 14 communicates with the hollow portion 13 in the depth direction Y. The hollow portion 13 functions as a pressure equalizing portion, and the wiping gas introduced into the hollow portion 13 from the gas supply pipe 17 via the gas supply path 16 is blown at a uniform pressure over the entire length direction X of the slit 14.

Figure 4:
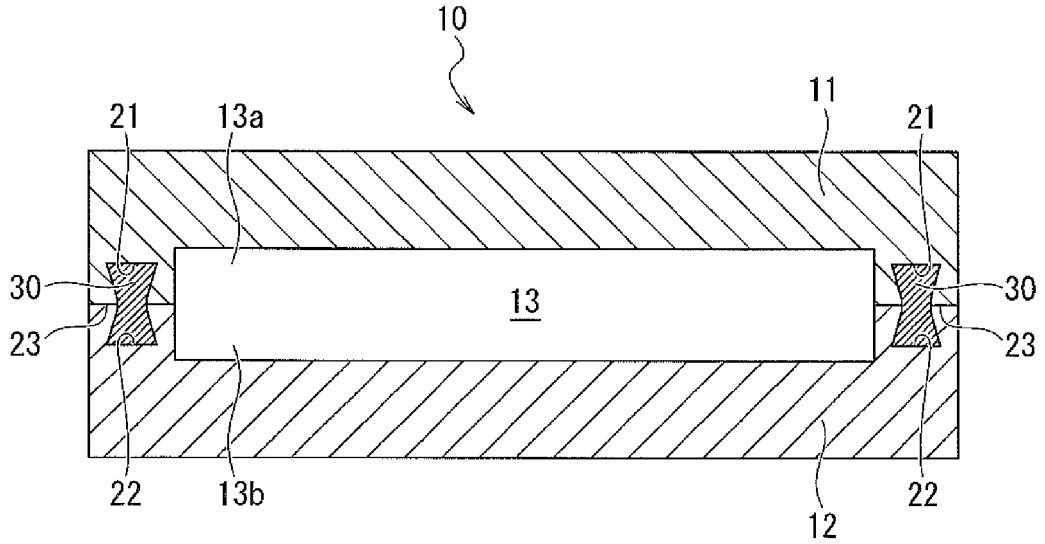
FIG. 4 is a cross-sectional view taken along line B-B in FIG. 3.
Figure 5:
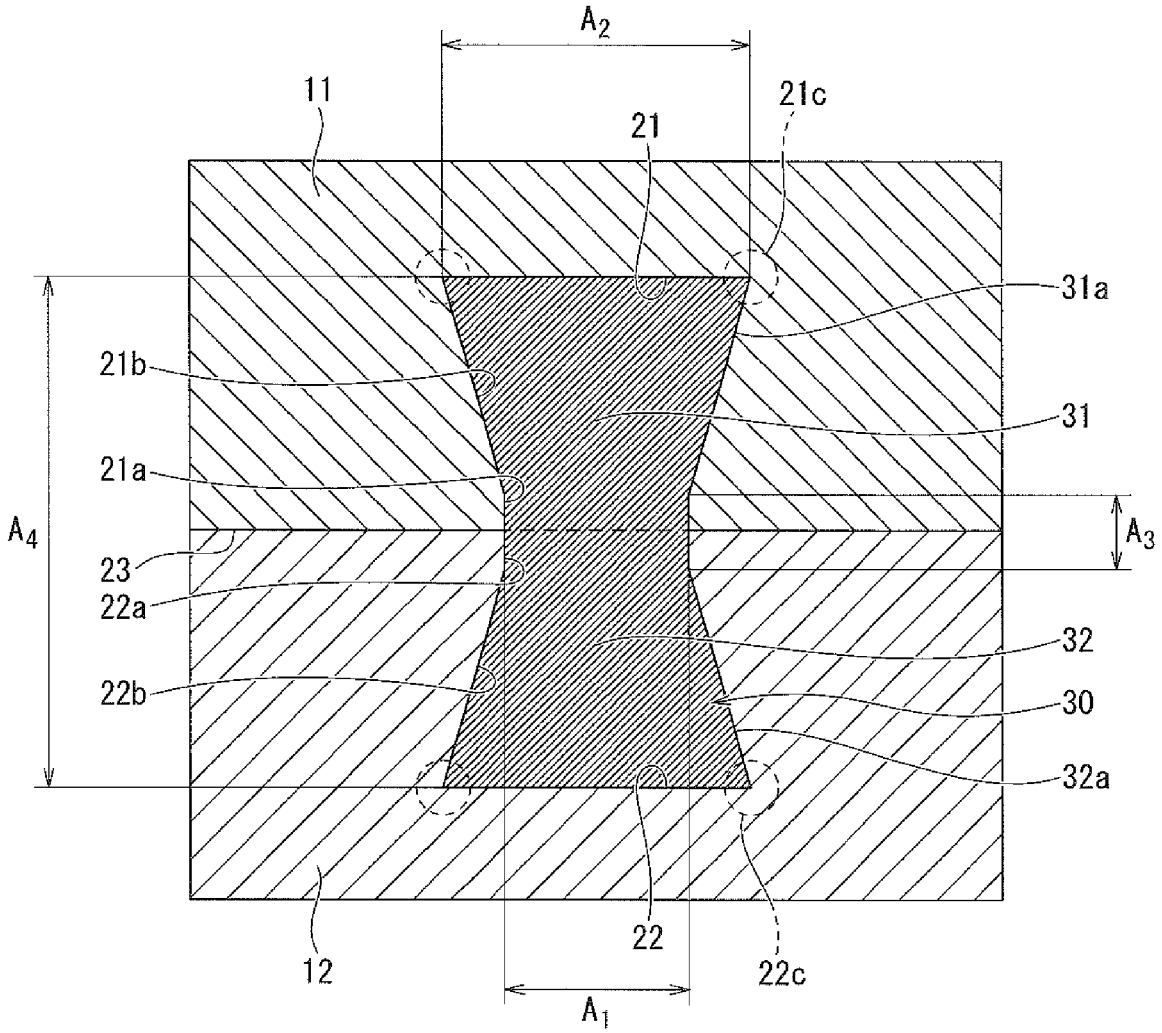
FIG. 5 is an enlarged view illustrating a vicinity of a groove portion of a first nozzle member, a groove portion of a second nozzle member, and a shim member in FIG. 4.

In addition, as illustrated in FIGS. 4 and 5, each gas wiping nozzle 10 includes a pair of shim members 30 for adjusting the gap $L_3$ in the width direction Z orthogonal to the length direction X of the slit 14.

These shim members 30 also have a function of fixing the first nozzle member 11 and the second nozzle member 12. To fix the first nozzle member 11 and the second nozzle member 12 by the shim members 30, the first nozzle member 11 and the second nozzle member 12 respectively have groove portions 21 and 22 into which these shim members 30 are fitted.

As illustrated in FIGS. 3 and 4, a pair of groove portions 21 of the first nozzle member 11 are formed on both sides of the hollow portion forming space 13*a* in the length direction X. Each groove portion 21 extends forward over a length 1 from the rear end surface 11*b* of the first nozzle member 11 to open on the lower surface of the first nozzle member 11, that is, a mating surface 23 with the second nozzle member 12.

In addition, as illustrated in FIGS. 3 and 4, a pair of groove portions 22 of the second nozzle member 12 are also formed on both sides of the hollow portion forming space 13*b* in the length direction X. Each groove portion 22 extends forward over the length 1 from the rear end surface 12*b* of the second nozzle member 12 to open on the upper surface of the second nozzle member 12, that is, the mating surface 23 with the first nozzle member 11. The length 1 of the groove portions 21 and 22 is approximately 5 mm, and the length 1 is not limited thereto.

As illustrated in FIG. 5, the groove portion 21 of the first nozzle member 11 and the groove portion 22 of the second nozzle member 12 communicate with each other on the mating surface 23 of the first nozzle member 11 and the second nozzle member 12, and are plane-symmetrical with the mating surface 23 as a plane of symmetry.

The cross-sectional shape of each of the groove portion 21 of the first nozzle member 11 and the groove portion 22 of the second nozzle member 12 is a dovetail groove shape as illustrated in FIG. 5. Specifically, the groove portion 21 of the first nozzle member 11 includes a linear portion 21*a* that opens on the mating surface 23 and extends linearly upward from the mating surface 23, and an inverted trapezoidal shaped dovetail-shaped portion 21*b* extending upward from the upper end of the linear portion 21*a* to gradually widen. In addition, the groove portion 22 of the second nozzle member 12 includes a linear portion 22*a* that opens on the mating surface 23 and extends linearly downward from the mating surface 23, and a trapezoidal shaped dovetail-shaped portion 22*b* extending downward from the lower end of the linear portion 22*a* to gradually widen. A corner portion 21*c* in the groove portion 21 and a corner portion 22*c* in the groove portion 22 may be formed in a rounded shape. As a result, stress concentration can be prevented and damage to the shim member 30 can be suppressed.

In addition, as illustrated in FIG. 3, each of the pair of shim members 30 is fitted into a pair of groove portions 21 and 22 formed on both sides of the hollow portion 13, and fixes the first nozzle member 11 and the second nozzle member 12. As illustrated in FIG. 5, the cross-sectional shape of each shim member 30 is complementary to a shape obtained by combining the dovetail groove shape of the groove portion 21 of the first nozzle member 11 and the dovetail groove shape of the groove portion 22 of the second nozzle member 12, which are plane-symmetrical with each other. Each shim member 30 includes a first fitting portion 31 fitted into the groove portion 21 of the first nozzle member 11, and a second fitting portion 32 fitted into the groove portion 22 of the second nozzle member 12, and the first fitting portion 31 and the second fitting portion 32 are integrally formed.

As illustrated in FIG. 5, the width $A_1$ of a narrowest portion (joint portion of the first fitting portion 31 and the second fitting portion 32) of each shim member 30 corresponding to the width of the linear portions 21*a* and 22*a* of the groove portions 21 and 22 is approximately 3 to 20 mm. In addition, the width $A_2$ of the widest portion (upper side of the first fitting portion 31 and lower piece of the second fitting portion 32) of each shim member 30 corresponding to the width of the widest portion of the dovetail-shaped portions 21*b* and 22*b* of the groove portions 21 and 22 is approximately 5 to 30 mm. In addition, the length $A_3$ of the linear portion of each shim member 30 corresponding to the vertically combined length of the linear portions 21*a* and 22*a* of the groove portions 21 and 22 is approximately 0 to 15 mm, and the height $A_4$ of each shim member 30 corresponding to the total vertical length of the groove portions 21 and 22 is approximately 10 to 40 mm. However, $A_1<A_2$ and $A_3<A_4$ are set. The length of each shim member 30 in the front-rear direction corresponding to the length 1 of the groove portions 21 and 22 in the front-rear direction is approximately 5 mm.

The shim member 30 is attachable to and detachable from each of the groove portions 21 and 22 in a direction parallel to the extending direction (front-rear direction) of each of the groove portions 21 and 22 of the first nozzle member 11 and the second nozzle member 12 from the rear end surface 11*b* of the first nozzle member 11 and the rear end surface 12*b* of the second nozzle member 12.

The first nozzle member 11, the second nozzle member 12, and each shim member 30 are made of a ceramic material or carbon material having low wettability with respect to molten metal such as hot-dip zinc, being hard to be plastically deformed, and having a low coefficient of linear expansion. Specifically, examples of the ceramic material include alumina, sialon, silicon nitride, zirconia, barium titanate, hydroxyapatite, silicon carbide (SiC), and fluorite, examples of the carbon material includes graphite, and the material is not limited thereto. In addition, since graphite oxidizes and volatilizes in a highly oxidizing atmosphere, it is preferable to coat the surface layer with silica or the like.

Since invar or tungsten has a low coefficient of linear expansion, but are plastically deformed, invar or tungsten is not suitable as a material for the first nozzle member 11, the second nozzle member 12, and each shim member 30, in particular, as a material for each shim member 30.

As the ceramic material or carbon material, those having a bending strength of 600 MPa or more are preferable, and those having a bending strength of 800 MPa or more are more preferable. Therefore, it is preferable to use zirconia, silicon nitride, sialon or the like as the ceramic material. When these materials are used, it is hard to be plastically deformed, and when an applied strength is equal to or lower than fracture strengths of these materials, substantial deformation can be suppressed.

When zinc adheres to the first nozzle member 11 and/or the second nozzle member 12 and closes the slit 14 during the operation of the actual machine, the amount of the coating to the steel strip S partially increases at that location, and linear defects occur in the same direction as the traveling direction of the steel strip S. Therefore, the zinc adhered to the first nozzle member 11 and/or the second nozzle member 12 is removed by a dedicated jig. At this time, when the hardness of the surfaces of the first nozzle member 11 and the second nozzle member 12 is low, cracks or chips may occur. To avoid such cracks and chips, the ceramic material and carbon material used for the first nozzle member 11, the second nozzle member 12, and each shim member 30 preferably have a Vickers hardness of 800 HV or more, and more preferably 1000 HV or more. For the same reason, a fracture toughness of the ceramic material or carbon material is preferably 5 $MPa \cdot m^{1/2}$ or more, and more preferably 7 $MPa \cdot m^{1/2}$ or more.

When a high-temperature gas is used as the wiping gas, cracks may occur when a thermal shock resistance of each of the first nozzle member 11 and the second nozzle member 12 is the high-temperature gas or less. Therefore, the thermal shock resistance of the ceramic material or carbon material is preferably the temperature or higher used as the wiping gas, the thermal shock resistance is preferably 430° C. or higher, and more preferably 600° C. or higher.

From the viewpoint of suppressing nozzle deformation due to thermal influence, the coefficient of linear expansion of the first nozzle member 11 and the second nozzle member 12 is preferably ½ or less, and more preferably ⅓ or less, with respect to the coefficient of linear expansion of the nozzle header 15 to which the first nozzle member 11 and the second nozzle member 12 are fixed.

Next, when a method of fixing the first nozzle member 11 and the second nozzle member 12 is described, first, the members are combined vertically with the first nozzle member 11 on the upper side and the second nozzle member 12 on the lower side.

Next, the first nozzle member 11 and the second nozzle member 12 are each subjected to dovetail groove processing from the rear end surfaces 11*b* and 12*b* to form the groove portions 21 and 22.

Thereafter, the shim member 30 is fitted into both of the groove portion 21 of the first nozzle member 11 and the groove portion 22 of the second nozzle member 12 in a direction parallel to the direction where the groove portions 21 and 22 extend from the rear end surfaces 11*b* and 12*b* of the first nozzle member 11 and the second nozzle member 12.

As a result, the first nozzle member 11 and the second nozzle member 12 are fixed. In a state where the shim member 30 is fitted into both of the groove portion 21 and the groove portion 22 as illustrated in FIG. 5, the first fitting portion 31 of the shim member 30 is fitted into the groove portion 21, and the second fitting portion 32 is fitted into the groove portion 22. In this state, when the first nozzle member 11 and the second nozzle member 12 tend to separate vertically, the first nozzle member 11 is caught on an inclined surface 31*a* of the first fitting portion 31 having a shape complementary to the inclined surface of the dovetail-shaped portion 21*b* of the groove portion 21. On the other hand, the second nozzle member 12 is caught on an inclined surface 32*a* of the second fitting portion 32 having a shape complementary to the inclined surface of the dovetail-shaped portion 22*b* of the groove portion 22. Since the shim member 30 is made of a material that is not easily plastically deformed, the first nozzle member 11 and the second nozzle member 12 are not separated from each other vertically. Since the first nozzle member 11 and the second nozzle member 12 are not separated from each other vertically, the gap $L_3$ of the slit 14 formed between the end portions 11*c* and 12*c* of the first nozzle member 11 and the second nozzle member 12 on the steel strip S side is held.

The rear end surface 11*b* of the fixed first nozzle member 11 and the rear end surface 12*b* of the fixed second nozzle member 12 may be connected to the front end surface of the nozzle header 15 by a fixing member such as a screw (not illustrated).

The step of forming the groove portions 21 and 22 by performing dovetail groove processing on the first nozzle member 11 and the second nozzle member 12 may be performed before combining the first nozzle member 11 on the upper side and the second nozzle member 12 on the lower side vertically. The first nozzle member 11 in which the groove portion 21 is formed and the second nozzle member 12 in which the groove portion 22 is formed are vertically combined so that the groove portion 21 and the groove portion 22 are plane-symmetrical. Thereafter, the shim member 30 is fitted in the direction parallel to the direction where the groove portions 21 and 22 extend from the rear end surfaces 11*b* and 12*b* of the first nozzle member 11 and the second nozzle member 12. When the first nozzle member 11 in which the groove portion 21 is formed and the second nozzle member 12 in which the groove portion 22 is formed are vertically combined so that the groove portion 21 and the groove portion 22 are plane-symmetrical, the accuracy of the groove portions 21 and 22 may be confirmed, and then the first nozzle member 11 and the second nozzle member 12 may be disassembled to be combined after the groove portions 21 and 22 are reprocessed. Alternatively, after combining the first nozzle member 11 in which the groove portion 21 is formed and the second nozzle member 12 in which the groove portion 22 is formed vertically so that the groove portion 21 and the groove portion 22 are plane-symmetrical, the groove portions 21 and 22 may be subjected to processing such as polishing to finish to a predetermined size.

When the gas wiping nozzle 10 is placed in a high temperature atmosphere, for example, when the wiping gas is heated and the gas wiping nozzle 10 itself is also heated with the heating of the wiping gas, the metal nozzle header 15 tends to extend in the vertical direction, that is, in the width direction Z of the slit 14 due to thermal expansion. As a result, the rear end surface 11*b* of the first nozzle member 11 and the second nozzle member 12 are also pulled by the metal nozzle header 15 and tend to separate from each other vertically. However, the first nozzle member 11 is caught on the inclined surface 31*a* of the first fitting portion 31 having a shape complementary to the inclined surface of the dovetail-shaped portion 21*b* of the groove portion 21. On the other hand, the second nozzle member 12 is caught on the inclined surface 32*a* of the second fitting portion 32 having a shape complementary to the inclined surface of the dovetail-shaped portion 22*b* of the groove portion 22. Since the shim member 30 is made of a material that is not easily plastically deformed, the first nozzle member 11 and the second nozzle member 12 are not separated from each other vertically. Since the first nozzle member 11 and the second nozzle member 12 are not separated from each other vertically, the gap $L_3$ of the slit 14 formed between the end portions 11*c* and 12*c* of the first nozzle member 11 and the second nozzle member 12 on the steel strip S side is held.

In addition, in the gas wiping nozzle 10 according to this example, since the first nozzle member 11, the second nozzle member 12, and the shim member 30 are all made of ceramic materials or carbon materials, the coefficient of linear expansion is small and there is no difference in the coefficient of linear expansion between these members. Therefore, even in a high temperature atmosphere, the gap $L_3$ in the width direction orthogonal to the length direction X of the slit 14 as the gas blowing port can be uniformly held along the length direction X of the slit. In particular, since the sheet thickness of each of the first nozzle member 11 and the second nozzle member 12 decreases from the rear side to the front side and there is a difference in sheet thickness, even when the same amount of heat is applied, the amount of temperature rise differs. Therefore, it is effective to use a ceramic material or carbon material with a small coefficient of linear expansion.

When the nozzle header 15 is also made of a ceramic material or a carbon material, it is more effective to uniformly hold the gap $L_3$ of the slit 14, but since it is difficult to use a ceramic material or carbon material that can withstand high-pressure wiping gas (can withstand at least 60 kPa), the nozzle header 15 is not made of a ceramic material or carbon material.

In addition, in the gas wiping nozzle described in JP '159, since the first lip portion and the second lip portion are fixed on the slit side in the nozzle chamber by the fixing member, it is possible to suppress variations in the slit gap after assembly for each assembly when replacing a part or all of the parts constituting the gas wiping nozzle.

However, since the fixing member for fixing the upper and lower nozzle members in the gas wiping nozzle described in JP '159 and the bolt used to fix the fixing member are made of metal, there is a problem that the fixing member, the bolt or the like extends in a high temperature atmosphere, which changes the slit gap, and the gap of the slit cannot be uniformly held along the length direction of the slit.

On the other hand, in our gas wiping nozzle 10, not only the first nozzle member 11 and the second nozzle member 12 are made of a ceramic material or a carbon material, but also the shim member 30 is made of a ceramic material or a carbon material and, furthermore, the shim member 30 also has a function of fixing the first nozzle member 11 and the second nozzle member 12. Therefore, there is no member that fixes the first nozzle member 11 and the second nozzle member 12 that acts to widen the gap $L_3$ of the slit 14 in a high temperature atmosphere. Since the shim member 30 is made of a material that is not easily plastically deformed, the gap $L_3$ of the slit 14 as the gas blowing port can be uniformly held along the length direction X of the slit even in a high temperature atmosphere.

In a configuration assuming that the shim member 30 does not have the function of fixing the first nozzle member 11 and the second nozzle member 12, and the first nozzle member 11 and the second nozzle member 12 that are made of ceramic materials are fixed by metal bolts, it is necessary to make bolt holes in the first nozzle member 11 and the second nozzle member 12 made of the ceramic materials and close the metal bolts in the bolt holes. Thus, the first nozzle member 11 and the second nozzle member 12, which are made of ceramic materials, may be damaged by the torque when the metal bolt is tightened or thermal expansion of the metal bolt.

On the other hand, in our gas wiping nozzle 10, not only the first nozzle member 11 and the second nozzle member 12 are made of a ceramic material or a carbon material, but also the shim member 30 is made of a ceramic material or a carbon material and, furthermore, the shim member 30 also has a function of fixing the first nozzle member 11 and the second nozzle member 12. Therefore, the first nozzle member 11 and the second nozzle member 12 are not damaged by the torque when the metal bolt is tightened or thermal expansion of the metal bolt.

Next, a modification example of the groove portion of the first nozzle member, the groove portion of the second nozzle member, and the shim member will be described with reference to FIGS. 6 and 7.

Figure 6:
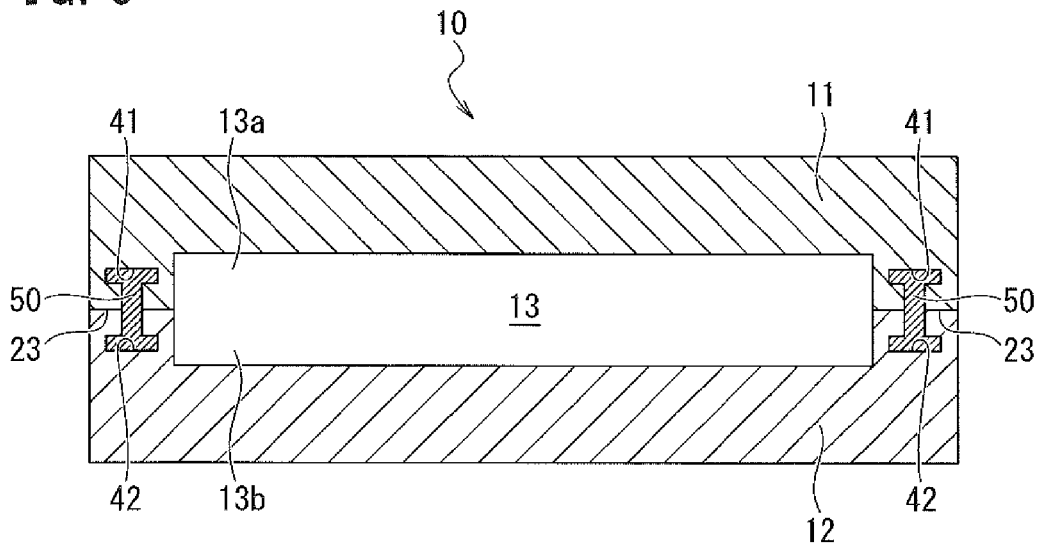
FIG. 6 is a view similar to FIG. 4 that shows a modification example of a groove portion of a first nozzle member, a groove portion of a second nozzle member, and a shim member.
Figure 7:
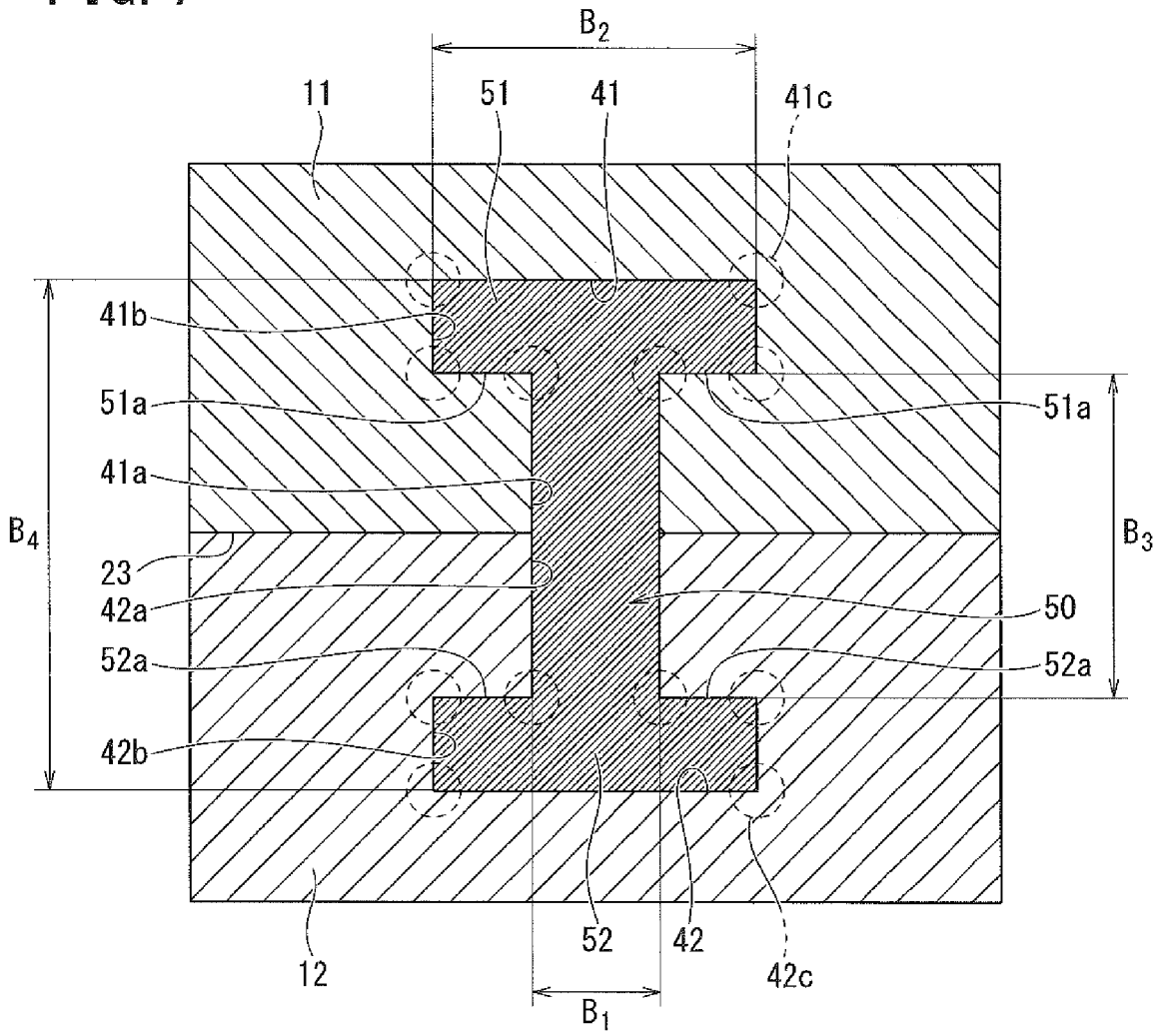
FIG. 7 is an enlarged view illustrating a vicinity of the groove portion of the first nozzle member, the groove portion of the second nozzle member, and the shim member in FIG. 6.

The basic configuration of a groove portion 41 of the first nozzle member 11 and a groove portion 42 of the second nozzle member 12 illustrated in FIGS. 6 and 7 is the same as that of the groove portion 21 of the first nozzle member 11 and the groove portion 22 of the second nozzle member 12 illustrated in FIGS. 3 to 5. However, the cross-sectional shapes of the groove portion 41 of the first nozzle member 11 and the groove portion 42 of the second nozzle member 12 are different from the cross-sectional shapes of the groove portion 21 of the first nozzle member 11 and the groove portion 22 of the second nozzle member 12 illustrated in FIGS. 3 to 5. With this difference in cross-sectional shape, the cross-sectional shape of a shim member 50 illustrated in FIGS. 6 and 7 is also different from the cross-sectional shape of the shim member 30 illustrated in FIGS. 3 to 5.

That is, the cross-sectional shape of each of the groove portion 41 of the first nozzle member 11 and the groove portion 42 of the second nozzle member 12 illustrated in FIGS. 6 and 7 is T-shaped groove shape. Specifically, the groove portion 41 of the first nozzle member 11 includes a first linear portion 41*a* that opens on the mating surface 23 and extends linearly upward from the mating surface 23, and a second linear portion 41*b* that extends symmetrically from the upper end of the first linear portion 41*a* with the first linear portion 41*a* interposed in parallel with the mating surface 23. In addition, the groove portion 42 of the second nozzle member 12 includes a first linear portion 42*a* that opens on the mating surface 23 and extends linearly downward from the mating surface 23, and a second linear portion 42*b* that extends symmetrically from the lower end of the first linear portion 42*a* with the first linear portion 42*a* interposed in parallel with the mating surface 23. A corner portion 41*c* in the groove portion 41 and a corner portion 42*c* in the groove portion 42 may be formed in a rounded shape. As a result, stress concentration can be prevented and damage to the shim member 50 can be suppressed.

The groove portion 41 of the first nozzle member 11 extends forward from the rear end surface 11*b* as shown in FIGS. 1 and 2 of the first nozzle member 11 over the length 1. In addition, the groove portion 42 of the second nozzle member 12 also extends forward from the rear end surface 12*b* as shown in FIGS. 1 and 2 of the second nozzle member 12 over the length 1. In this example, the length 1 of the groove portions 41 and 42 in the front-rear direction is approximately 5 mm.

In addition, as illustrated in FIG. 6, the cross-sectional shape of the shim member 50 is complementary to an I-shaped groove shape obtained by combining the T-shaped groove shape of the groove portion 41 of the first nozzle member 11 and the T-shaped groove shape of the groove portion 42 of the second nozzle member 12, which are plane-symmetrical with each other. As illustrated in FIG. 7, the shim member 50 includes a first fitting portion 51 fitted into the groove portion 41 of the first nozzle member 11 and a second fitting portion 52 fitted into the groove portion 42 of the second nozzle member 12, and the first fitting portion 51 and the second fitting portion 52 are integrally formed.

As illustrated in FIG. 7, the width $B_1$ of a narrowest portion of the shim member 50 corresponding to the width of the first linear portions 41*a* and 42*a* of the groove portions 41 and 42 is approximately 3 to 20 mm, and the width $B_2$ of a widest portion of the shim member 50 (upper side of the first fitting portion 51 and lower piece of the second fitting portion 52) corresponding to the width of a widest portion of the second linear portions 41*b* and 42*b* of the groove portions 41 and 42 is approximately 5 to 30 mm. In addition, the length $B_3$ of the linear portion of the shim member 50 corresponding to the vertically combined length of the first linear portions 41*a* and 42*a* of the groove portions 41 and 42 is approximately 5 to 50 mm, and the height $B_4$ of the shim member 50 corresponding to the total vertical length of the groove portions 41 and 42 is approximately 10 to 40 mm. However, $B_1<B_2$ and $B_3<B_4$ are set. The length of the shim member 50 in the front-rear direction corresponding to the length 1 of the groove portions 41 and 42 in the front-rear direction is approximately 5 mm.

In a state where the shim member 50 is fitted into both of the groove portion 41 and the groove portion 42 as illustrated in FIG. 7, the first fitting portion 51 of the shim member 50 is fitted into the groove portion 41, and the second fitting portion 52 is fitted into the groove portion 42. In this state, when the first nozzle member 11 and the second nozzle member 12 tend to separate vertically, the first nozzle member 11 is caught on a lower surface 51*a* of a wide portion of the first fitting portion 51 having a shape complementary to the second linear portion 41*b* of the groove portion 41. On the other hand, the second nozzle member 12 is caught on an upper surface 52*a* of a wide portion of the second fitting portion 52 having a shape complementary to the second linear portion 42*b* of the groove portion 42. Since the shim member 50 is made of a material that is not easily plastically deformed, the first nozzle member 11 and the second nozzle member 12 are not separated from each other vertically. Since the first nozzle member 11 and the second nozzle member 12 are not separated from each other vertically, the gap $L_3$ of the slit 14 formed between the end portions 11*c* and 12*c* of the first nozzle member 11 and the second nozzle member 12 on the steel strip S side is held.

When the gas wiping nozzle 10 illustrated in FIGS. 6 and 7 is placed in a high temperature atmosphere, for example, when the wiping gas is heated and the gas wiping nozzle 10 itself is also heated with the heating of the wiping gas, the metal nozzle header 15 as shown in FIGS. 1 and 2 tends to extend in the vertical direction, that is, in the width direction Z of the slit 14 due to thermal expansion. As a result, the rear end surface 11*b* of the first nozzle member 11 and the second nozzle member 12 are also pulled by the metal nozzle header 15 and tend to separate from each other vertically. However, the first nozzle member 11 is caught on the lower surface 51*a* of the wide portion of the first fitting portion 51 having a shape complementary to the second linear portion 41*b* of the groove portion 41. On the other hand, the second nozzle member 12 is caught on the upper surface 52*a* of a wide portion of the second fitting portion 52 having a shape complementary to the second linear portion 42*b* of the groove portion 42. Since the shim member 50 is made of a material that is not easily plastically deformed, the first nozzle member 11 and the second nozzle member 12 are not separated from each other vertically. Since the first nozzle member 11 and the second nozzle member 12 are not separated from each other vertically, the gap $L_3$ of the slit 14 formed between the end portions 11*c* and 12*c* of the first nozzle member 11 and the second nozzle member 12 on the steel strip S side is held.

Since the shim member 50 is made of a ceramic material or a carbon material as well as the first nozzle member 11 and the second nozzle member 12, and also has a function of fixing the first nozzle member 11 and the second nozzle member 12, the shim member 50 exhibits the same effect as when the groove portions 21 and 22 and the shim member 30 illustrated in FIGS. 3 to 5 are used.

Next, an example in which a pin is used to connect the groove portion of the first nozzle member and the shim member and connect the groove portion of the second nozzle member and the shim member will be described with reference to FIGS. 8 and 9.

Figure 8:
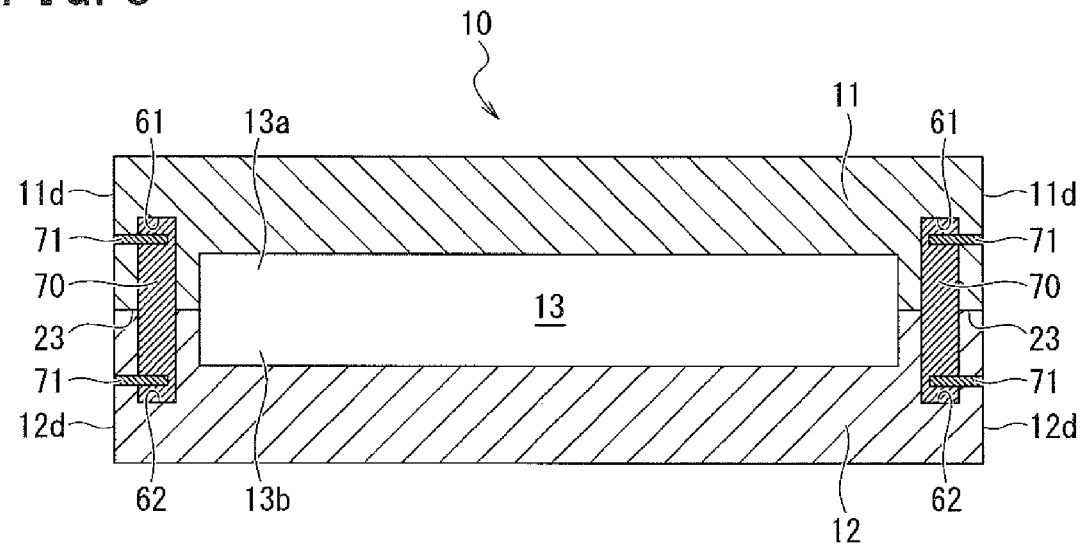
FIG. 8 is a view similar to FIG. 4 that shows an example in which a pin is used to connect the groove portion of the first nozzle member and the shim member and connecting the groove portion of the second nozzle member and the shim member.
Figure 9:
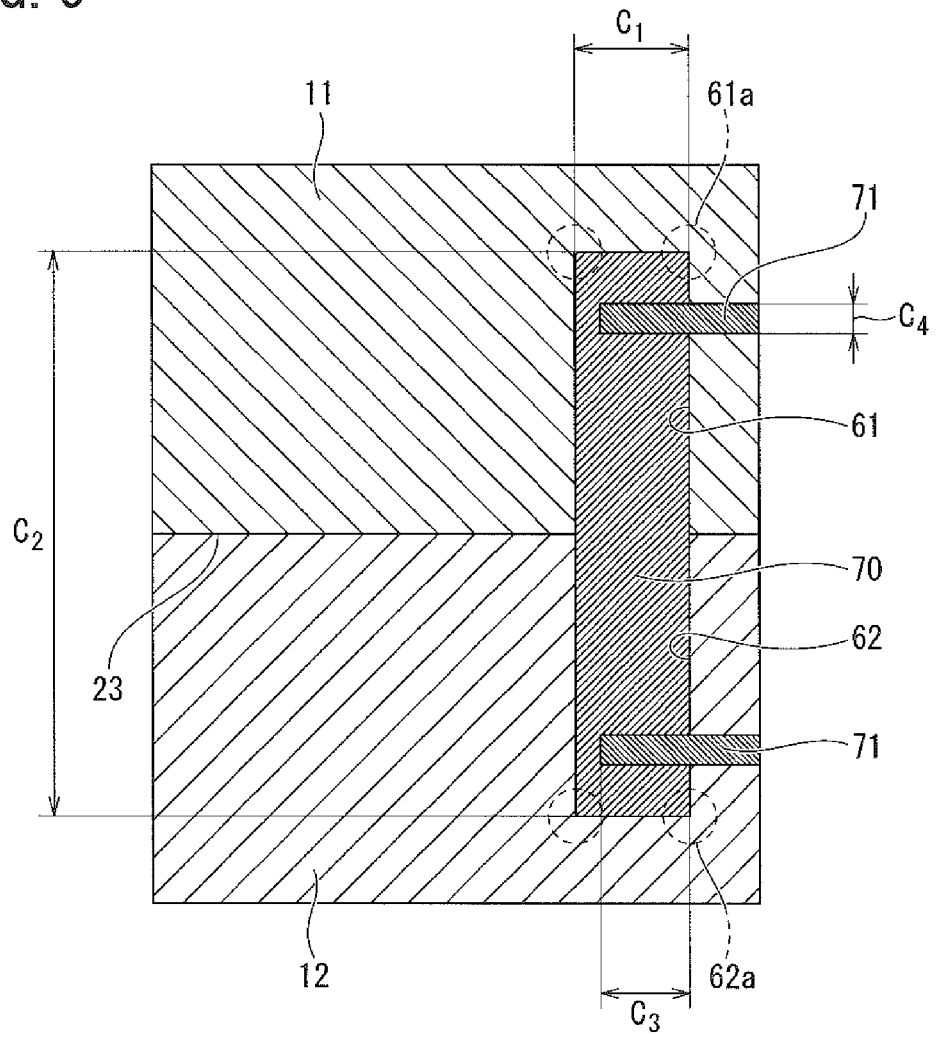
FIG. 9 is an enlarged view illustrating a vicinity of the groove portion of the first nozzle member, the groove portion of the second nozzle member, the shim member, and the pin in FIG. 8.

First, the basic configuration of a groove portion 61 of the first nozzle member 11 and a groove portion 62 of the second nozzle member 12 illustrated in FIGS. 8 and 9 is the same as that of the groove portion 21 of the first nozzle member 11 and the groove portion 22 of the second nozzle member 12 illustrated in FIGS. 3 to 5. However, the cross-sectional shapes of the groove portion 61 of the first nozzle member 11 and the groove portion 62 of the second nozzle member 12 are different from the cross-sectional shapes of the groove portion 21 of the first nozzle member 11 and the groove portion 22 of the second nozzle member 12 illustrated in FIGS. 3 to 5. With this difference in cross-sectional shape, the cross-sectional shape of a shim member 70 illustrated in FIGS. 8 and 9 is also different from the cross-sectional shape of the shim member 30 illustrated in FIGS. 3 to 5.

The cross-sectional shape of each of the groove portion 61 of the first nozzle member 11 and the groove portion 62 of the second nozzle member 12 illustrated in FIGS. 8 and 9 is a rectangular shape. The groove portion 61 of the first nozzle member 11 extends forward from the rear end surface 11*b* as shown in FIGS. 1 and 2 of the first nozzle member 11 over the length 1. In addition, the groove portion 62 of the second nozzle member 12 also extends forward from the rear end surface 12*b* as shown in FIGS. 1 and 2 of the second nozzle member 12 over the length 1. In this example, the length 1 of the groove portions 41 and 42 in the front-rear direction is approximately 5 mm. In addition, a corner portion 61*c* in the groove portion 61 and a corner portion 62*c* in the groove portion 62 may be formed in a rounded shape. As a result, stress concentration can be prevented and damage to the shim member 70 can be suppressed.

In addition, the shim member 70 has a rectangular parallelepiped shape and, as illustrated in FIG. 9, the cross-sectional shape thereof is complementary to a rectangular shape obtained by combining the rectangular shape of the groove portion 61 of the first nozzle member 11 and the rectangular shape of the groove portion 62 of the second nozzle member 12, which are plane-symmetrical with each other. As illustrated in FIG. 9, the width $C_1$ of the shim member 70 corresponding to the width of the groove portions 61 and 62 is approximately 5 to 20 mm, the height $C_2$ of the shim member 70 corresponding to the vertically combined length of the groove portions 61 and 62 is approximately 5 to 40 mm, and the length of the shim member 70 in the front-rear direction corresponding to the length 1 of the groove portions 61 and 62 in the front-rear direction as shown in FIG. 3 is approximately 5 mm.

When fixing the first nozzle member 11 and the second nozzle member 12, the shim member 70 is fitted into both of the groove portion 61 of the first nozzle member 11 and the groove portion 62 of the second nozzle member 12. Furthermore, a plurality of pins 71 are used to connect the groove portion 61 of the first nozzle member 11 to the shim member 70, and to connect the groove portion 62 of the second nozzle member 12 to the shim member 70. As described above, in this example, the shim member 70 can be fitted before the first nozzle member 11 and the second nozzle member 12 are combined so that assembling is possible without inserting the shim member 70 into the groove portions 61 and 62 from the rear end surfaces 11*b* and 12*b* of the first nozzle member 11 and the second nozzle member 12. Therefore, the shim member 70 may be provided at a plurality of locations in the depth direction Y of the first nozzle member 11 and the second nozzle member 12. As a result, the gap $L_3$ of the slit 14 can be held with higher accuracy.

As illustrated in FIG. 8, as the pin 71, *a* total of four pins 71 are used, two pins used to connect the groove portion 61 of the first nozzle member 11 and the shim member 70, and two pins used to connect the groove portion 62 of the second nozzle member 12 and the shim member 70. When the shim member 70 is provided at a plurality of locations in the depth direction Y of the first nozzle member 11 and the second nozzle member 12, the number of pins used may be increased according to the number of shim members 70.

When connecting the groove portion 61 of the first nozzle member 11 and the shim member 70, as illustrated in FIGS. 8 and 9, the pin 71 is inserted into the shim member 70 from the side surface 11*d* of the first nozzle member 11 to a predetermined depth $C_3$ after the shim member 70 is fitted into the groove portions 61 and 62. Similarly, when connecting the groove portion 62 of the second nozzle member 12 to the shim member 70, as illustrated in FIGS. 8 and 9, the pin 71 is inserted into the shim member 70 from the side surface 12*d* of the second nozzle member 12 to a predetermined depth $C_3$ after the shim member 70 is fitted into the groove portions 61 and 62.

Each pin 71 is formed of a cylinder, and the diameter $C_4$ thereof is approximately Φ1 to 10 mm, and the insertion depth $C_3$ of the pin 71 is approximately 1 to 15 mm. However, the insertion depth $C_3$ of the pin 71<the width $C_1$ of the shim member 70, and the diameter $C_4$ of the pin 71<the height $C_2$ of the shim member 70 are set. Similarly, as the material of each pin 71, a ceramic material or a carbon material is preferable. In addition, the bending strength of each pin 71 is preferably 600 MPa or more, and more preferably 800 MPa or more. Therefore, it is preferable to use zirconia, silicon nitride, sialon or the like as the ceramic material.

When the gas wiping nozzle 10 illustrated in FIGS. 8 and 9 is placed in a high temperature atmosphere, for example, when the wiping gas is heated and the gas wiping nozzle 10 itself is also heated with the heating of the wiping gas, the metal nozzle header 15 as shown in FIGS. 1 and 2 tends to extend in the vertical direction, that is, in the width direction Z of the slit 14 due to thermal expansion. As a result, the rear end surface 11*b* of the first nozzle member 11 and the second nozzle member 12 are also pulled by the metal nozzle header 15 and tend to separate from each other vertically. However, since the first nozzle member 11 and the second nozzle member 12 are connected to the shim member 70 by the pin 71 and the shim member 70 is made of a material that is not easily plastically deformed, the first nozzle member 11 and the second nozzle member 12 do not separate vertically. Since the first nozzle member 11 and the second nozzle member 12 are not separated from each other vertically, the gap $L_3$ of the slit 14 formed between the end portions 11*c* and 12*c* of the first nozzle member 11 and the second nozzle member 12 on the steel strip S side is held.

Next, in the manufacturing of the steel strip S, it is preferable to control the temperature of the wiping gas so that the temperature T (° C.) of the wiping gas immediately after being blown from the slit 14 of the gas wiping nozzle 10 satisfies $T_M-150 \leq T \leq T_M+250$ in relation to the melting point $T_M$ (° C.) of the molten metal. When the temperature T (° C.) of the wiping gas is controlled in this range, cooling and solidification of the molten metal can be suppressed so that uneven viscosity is unlikely to occur and the occurrence of hot metal wrinkles can be suppressed. On the other hand, when the temperature T (° C.) of the wiping gas is less than $T_M-150$° C. and is too low, the temperature T does not affect the fluidity of the molten metal and is not effective in suppressing the occurrence of hot metal wrinkles. In addition, when the temperature T (° C.) of the wiping gas is higher than $T_M+250$° C., alloying is promoted and the appearance of the steel sheet is deteriorated.

In addition, a method of raising the temperature of the wiping gas supplied to the gas wiping nozzle 10 is not particularly limited. Examples thereof include a method of heating with a heat exchanger and raising the temperature to supply, and a method of mixing the combustion exhaust gas of the annealing furnace with air.

In addition, examples of the hot-dip metal coated metal strip manufactured by applying the gas wiping nozzle and the method of manufacturing the hot-dip metal coated metal strip include a hot-dip galvanized steel strip. The hot-dip galvanized steel strip includes both a coated steel sheet (GI) that is not subjected to an alloying treatment after the hot-dip galvanized treatment and a coated steel sheet (GA) that is subjected to the alloying treatment. However, the hot-dip metal coated metal strip manufactured by applying the gas wiping nozzle and the method of manufacturing the hot-dip metal coated metal strip is not limited thereto, and includes all hot-dip metal coated steel strips containing other molten metals such as aluminum and tin other than zinc.

Although examples of our nozzles and methods are described above, this disclosure is not limited thereto, and various modifications and improvements can be made.

For example, only the shim member may be made of a ceramic material or a carbon material, and it is not always necessary that the first nozzle member 11 and the second nozzle member 12 are made of a ceramic material or a carbon material.

In addition, although the first nozzle member 11, the second nozzle member 12, and the shim member are all made of a ceramic material or a carbon material, this is a concept that the first nozzle member 11, the second nozzle member 12, and the shim member may not all be made of the same material. However, it is preferable that the first nozzle member 11, the second nozzle member 12, and the shim member are all made of the same material. As a result, the difference in the coefficient of linear expansion between the first nozzle member 11, the second nozzle member 12, and the shim member can be surely eliminated.

In addition, as long as a shim member is fitted into each of the groove portions 21 and 41 of the first nozzle member 11 and the groove portions 22 and 42 of the second nozzle member 12, and the first nozzle member 11 and the second nozzle member 12 can be fixed, the groove portions do not necessarily need to be plane-symmetrical with the mating surface 23 of the first nozzle member 11 and the second nozzle member 12 as a plane of symmetry.

In addition, as long as a shim member is fitted into each of the groove portions 21 and 41 of the first nozzle member 11 and the groove portions 22 and 42 of the second nozzle member 12, and the first nozzle member 11 and the second nozzle member 12 can be fixed, the cross-sectional shape of the groove portions 21 and 41 of the first nozzle member 11 and the groove portions 22 and 42 of the second nozzle member 12 need not be a dovetail groove shape or a T-shaped groove shape.

In addition, as long as the shim member is fitted into each of the groove portions 21 and 41 of the first nozzle member 11 and the groove portions 22 and 42 of the second nozzle member 12, and the first nozzle member 11 and the second nozzle member 12 can be fixed, the cross-sectional shape of the shim member need not be complementary to a shape obtained by combining the dovetail groove shape and T-shaped groove shape of the groove portions 21 and 41 of the first nozzle member 11, and the dovetail groove shape and T-shaped groove shape of the groove portions 22 and 42 of the second nozzle member 12, which are plane-symmetrical with each other.

In addition, the shim member is not limited to an aspect in which two shim members are provided as independent members in the length direction X. For example, as long as portions of the shim member are fitted into the groove portions of the first nozzle member 11 and the groove portion of the second nozzle member 12, the shim member may be an integral member by providing a connecting portion for connecting the portions to be fitted into the groove portions of the nozzle members.

In addition, when the groove portion 61 of the first nozzle member 11 is connected to the shim member 70 and the groove portion 62 of the second nozzle member 12 is connected to the shim member 70 by using the pin 71, the cross-sectional shape of the groove portions 61 and 62 is not limited to a rectangular shape, and may be a dovetail groove shape, a T-shaped groove shape, or another shape. In addition, the cross-sectional shape of the shim member 70 may be changed according to the cross-sectional shape of the groove portions 61 and 62. In addition, the shape of the pin 71 does not need to be a cylinder, and may be a rectangular parallelepiped or another shape.

When a distance between the mating surfaces 23 of the first nozzle member 11 and the second nozzle member 12 changes, the wiping gas may leak from the mating surfaces 23. Therefore, groove portions extending in the depth direction Y, which are separate from the groove portions 21 and 22, may be formed in the first nozzle member 11 and the second nozzle member 12, and a side wall (not illustrated) having a height of 5 to 10 mm and a length matching the mating surfaces 23 may be inserted into each of the groove portions to prevent gas leakage from the mating surfaces 23.

The side wall that prevents leakage of the wiping gas from the mating surfaces 23 and the shim member may be the same member. In this example, the shim member is preferably set to a height of approximately 5 to 10 mm so that the height in the slit width direction Z is smaller toward the slit 14 side in the depth direction Y. In addition, in this example, it is preferable to match the length of the shim member in the front-rear direction with the length of the mating surfaces 23 in the depth direction Y to prevent gas leakage from the mating surfaces 23. When the shim member also serves as a side wall, and the cross-sectional shape is rectangular, it is necessary to fix the shim member to the groove portion 21 of the first nozzle member 11 and the groove portion 22 of the second nozzle member 12 by using the pin 71.

EXAMPLE

Using the continuous hot-dip metal coating equipment 1 having the basic configuration illustrated in FIG. 1, a hot-dip galvanized steel strip was manufactured by passing a steel strip S having a sheet thickness of 1.0 mm and a sheet width of 1200 mm into a hot-dip zinc bath at a sheet speed of 2.0 m/s. The dimensions of the slit 14 of the wiping nozzle 10 are 1800 mm for the length $L_1$, 20 mm for the depth $L_2$, and 1.2 mm for the width (gap) $L_3$. In addition, the hot-dip galvanizing bath temperature at the time of the experiment was 460° C., and the gas temperature T at the tip end of the wiping nozzle was 500° C. As the wiping gas, a gas prepared by mixing the exhaust gas of the combustor and air was used. In addition, the melting point $T_M$ of the hot-dip galvanizing bath is 420° C.

The bending strength of sialon described in the following Examples and Comparative Examples is 980 MPa, the Vickers hardness is 1620 HV, the fracture toughness is 6 $MPa \cdot m^{1/2}$, the thermal shock resistance is 650° C., and the coefficient of linear expansion is $3.2 \times 10^{-6}$/K. In addition, the yield stress of chrome molybdenum steel is 400 MPa, the Vickers hardness is 300 HV, the fracture toughness is 236 $MPa \cdot m^{1/2}$, and the coefficient of linear expansion is $11.2 \times 10^{-6}$/K.

Hereinafter, the materials and structures of the gas wiping nozzles of Examples 1 to 3 and Comparative Examples 1 and 2 will be described.

Example 1

In Example 1, the materials of the first nozzle member 11, the second nozzle member 12, and the shim member 30 were all sialon, and the material of the nozzle header 15 was chrome molybdenum steel. In addition, as illustrated in FIGS. 4 and 5, the cross-sectional shape of each of the groove portion 21 of the first nozzle member 11 and the groove portion 22 of the second nozzle member 12 was a dovetail groove shape, and the cross-sectional shape of the shim member 30 was complementary to a shape obtained by combining the dovetail groove shape of the groove portion 21 of the first nozzle member 11 and the dovetail groove shape of the groove portion 22 of the second nozzle member 12, which were plane-symmetrical with each other. The width $A_1$ of the narrowest portion of the shim member 30 was 5 mm, the width $A_2$ of the widest portion of the shim member 30 was 15 mm, the length $A_3$ of the linear portion of the shim member 30 was 5 mm, the height $A_4$ of the shim member 30 was 20 mm, and the length of the shim member 30 in the front-rear direction was 5 mm.

Example 2

In Example 2, the materials of the first nozzle member 11, the second nozzle member 12, and the shim member 30 were all sialon, and the material of the nozzle header 15 was chrome molybdenum steel. In addition, as illustrated in FIGS. 6 and 7, the cross-sectional shape of each of the groove portion 41 of the first nozzle member 11 and the groove portion 42 of the second nozzle member 12 was a T-shaped groove shape, and the cross-sectional shape of the shim member 50 was complementary to an I-shaped groove shape obtained by combining the T-shaped groove shape of the groove portion 41 of the first nozzle member 11 and the T-shaped groove shape of the groove portion 42 of the second nozzle member 12, which were plane-symmetrical with each other. The width $B_1$ of the narrowest portion of the shim member 50 was 5 mm, the width $B_2$ of the widest portion of the shim member 50 was 15 mm, the length $B_3$ of the linear portion of the shim member 50 was 10 mm, the height $B_4$ of the shim member 50 was 20 mm, and the length of the shim member 50 in the front-rear direction was 5 mm.

Example 3

In Example 3, the materials of the first nozzle member 11, the second nozzle member 12, and the shim member 30 were all sialon, and the material of the nozzle header 15 was chrome molybdenum steel. In addition, as illustrated in FIGS. 8 and 9, the cross-sectional shape of each of the groove portion 61 of the first nozzle member 11 and the groove portion 62 of the second nozzle member 12 was rectangular, and the shim member 70 had a rectangular parallelepiped shape. The width $C_1$ of the shim member 70 was 15 mm, the height $C_2$ of the shim member 50 was 20 mm, and the length of the shim member 70 in the front-rear direction was 5 mm.

In addition, the pin 71 was used to connect the groove portion 61 of the first nozzle member 11 to the shim member 70, and to connect the groove portion 62 of the second nozzle member 12 to the shim member 70. The insertion depth $C_3$ of the pin 71 was 10 mm, and the diameter $C_4$ of the pin 71 was Φ3 mm.

Comparative Example 1

Figure 10:
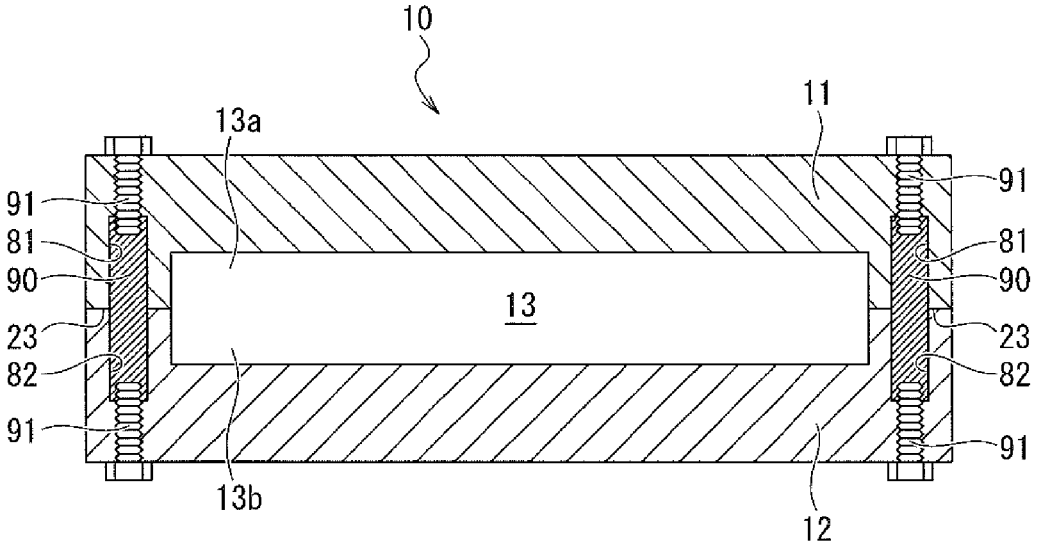
FIG. 10 is a view similar to FIG. 4 that shows a Comparative Example.

FIG. 10 illustrates a cross section that shows a structure of a gas wiping nozzle of Comparative Example 1

In the gas wiping nozzle 10 illustrated in FIG. 10, a pair of groove portions 81 of the first nozzle member 11 are formed on both sides of the hollow portion forming space 13*a* in the length direction X, and a pair of groove portions 82 of the second nozzle member 12 are formed on both sides of the hollow portion forming space 13*b* in the length direction X. Each of the groove portions 81 and 82 is formed to open on the mating surface 23 of the first nozzle member 11 and the second nozzle member 12, and extends forward from the rear end surface of the first nozzle member 11 or the rear end surface of the second nozzle member 12 over a predetermined length.

The groove portion 81 of the first nozzle member 11 and the groove portion 82 of the second nozzle member 12 communicate with each other on the mating surface 23 of the first nozzle member 11 and the second nozzle member 12, and are plane-symmetrical with the mating surface 23 as a plane of symmetry.

The cross-sectional shape of each of the groove portion 81 of the first nozzle member 11 and the groove portion 82 of the second nozzle member 12 is rectangular, and a shim member 90 fitted into a pair of groove portions 81 and 82 has a rectangular parallelepiped shape.

Furthermore, to fix the shim member 90 fitted into the pair of groove portions 81 and 82 to the first nozzle member 11 and the second nozzle member 12, the shim member 90 is interposed between two metal bolts 91 from above and below the first nozzle member 11 and the second nozzle member 12. As a result, the shim member 90 is fixed to the first nozzle member 11 and the second nozzle member 12, and the first nozzle member 11 and the second nozzle member 12 are fixed.

That is, in Examples 1 to 3, by devising the shape of each of the groove portions of the first nozzle member 11 and the second nozzle member 12 and the shape of the shim member fitted therein, the first nozzle member 11 and the second nozzle member 12 are fixed without using bolts. However, in Comparative Example 1, the first nozzle member 11 and the second nozzle member 12 are fixed by using the metal bolts 91.

In addition, in Comparative Example 1, in the gas wiping nozzle 10 having such a structure, the materials of the first nozzle member 11, the second nozzle member 12, the shim member 90, and the nozzle header 15 were all chrome molybdenum steel.

Comparative Example 2

In Comparative Example 2, a structure of the gas wiping nozzle is the same as that illustrated in FIG. 10. That is, in Comparative Example 2, in the gas wiping nozzle 10, the first nozzle member 11 and the second nozzle member 12 are fixed by using the metal bolts 91 as in Comparative Example 1.

In addition, in Comparative Example 2, in the gas wiping nozzle 10 having such a structure, the materials of the first nozzle member 11, the second nozzle member 12, and the shim member 90 were all sialon, and the material of the nozzle header 15 was chrome molybdenum steel.

In Examples 1 to 3 and Comparative Examples 1 and 2, a nozzle damage state, a change rate in the slit gap, a deviation of the amount of coating in the width direction, and a generation rate of linear marks were evaluated. The change rate in the slit gap (%) is a value indicated by the amount of the maximum slit gap (size of gap $L_3$ in width direction Z orthogonal to length direction X of slit 14) in the width direction (length direction X of slit 14) of the wiping nozzle 10/the amount of the minimum slit gap×100. In addition, the deviation of the amount of coating in the width direction (%) is a value indicated by the amount of the maximum coating in the width direction of the steel strip S/the amount of the minimum coating×100. Furthermore, the generation rate of linear marks (%) is a ratio of a length of the steel strip S visually determined to have a linear mark defect in an inspection step to a length of the steel strip S passed under each manufacturing condition.

The evaluation results are illustrated in Table 1.

TABLE 1

| Classification | Nozzle damage [-] | Change rate in gap [%] | Deviation of amount of coating in width direction [%] | Generation rate of linear marks [%] |
|---|---|---|---|---|
| Example 1 | Absent | 101 | 108 | 0.28 |
| Example 2 | Absent | 101 | 110 | 0.29 |
| Example 3 | Absent | 103 | 112 | 0.24 |
| Comparative Example 1 | Absent | 175 | 217 | 1.61 |
| Comparative Example 2 | Present | 138 | 163 | 0.94 |

As is clear from Table 1, in Examples 1 to 3, the change rate in the slit gap, the deviation of the amount of coating in the width direction, and the generation rate of linear marks could be significantly reduced compared to Comparative Examples 1 and 2.

In addition, after manufacturing was completed, although the first nozzle member 11 and the second nozzle member 12 were disassembled and visually inspected, no nozzle damage was observed under any of the conditions of Examples 1 to 3 and Comparative Example 1. On the other hand, in Comparative Example 2, the nozzle damage was observed. We believe that this is because the ceramics (sialon) having a toughness lower than that of the metal were damaged due to the thermal expansion of the metal bolt 91.

In any of Examples 1 to 3 and Comparative Examples 1 and 2, the temperature of the wiping gas is controlled so that the temperature T (° C.) of the wiping gas immediately after being blown from the slit 14 of the gas wiping nozzle 10 satisfies $T_M-150 \leq T \leq T_M+250$ in relation to the melting point $T_M$ (° C.) of the molten metal. Therefore, no hot metal wrinkle defect occurred in any of the Examples 1 to 3 and Comparative Examples 1 and 2.

Therefore, we confirmed that, with our gas wiping nozzle and our method of manufacturing the hot-dip metal coated metal strip, the gap $L_3$ in the width direction Z orthogonal to the length direction X of the slit 14 as the gas blowing port can be uniformly held along the length direction X of the slit 14 even in a high temperature atmosphere.

The invention claimed is:

1. A gas wiping nozzle configured to blow wiping gas onto a metal strip pulled up from a molten metal bath and adjust an amount of a molten metal coated to a surface of the metal strip, the gas wiping nozzle comprising: a first nozzle member and a second nozzle member arranged to face each other, in which a slit as a gas blowing port is formed to extend in a length direction between end portions of the first nozzle member and the second nozzle member on a metal strip side; and a shim member configured to adjust a gap of the slit in a width direction orthogonal to the length direction, wherein the shim member is made of a ceramic material or a carbon material, each of the first nozzle member and the second nozzle member has a groove portion, and the shim member is fitted into both of the groove portions of the first nozzle member and the second nozzle member and the shim member fixes the first nozzle member and the second nozzle member to each other; and wherein a coefficient of linear expansion of the first nozzle member and a coefficient of linear expansion of the second nozzle member is ½ or less than a coefficient of linear expansion of a nozzle header to which the first nozzle member and the second nozzle member are fixed.

2. The gas wiping nozzle according to claim 1, wherein the first nozzle member and the second nozzle member are made of a ceramic material or a carbon material.

3. The gas wiping nozzle according to claim 2, wherein the first nozzle member, the second nozzle member, and the shim member are all made of a same material.

4. The gas wiping nozzle according to claim 1, wherein a bending strength of the ceramic material or the carbon material is 600 MPa or more.

5. The gas wiping nozzle according to claim 1, wherein a Vickers hardness of the ceramic material or the carbon material is 800 HV or more.

6. The gas wiping nozzle according to claim 1, wherein a fracture toughness of the ceramic material or the carbon material is 5 $MPa \cdot m^{1/2}$ or more.

7. The gas wiping nozzle according to claim 1, wherein a thermal shock resistance of the ceramic material or the carbon material is 430° C. or higher.

8. The gas wiping nozzle according to claim 1, wherein the groove portion of the first nozzle member and the groove portion of the second nozzle member communicate with each other on a mating surface of the first nozzle member and the second nozzle member, and are plane-symmetrical with the mating surface as a plane of symmetry.

9. The gas wiping nozzle according to claim 8, wherein a cross-sectional shape of each of the groove portions of the first nozzle member and the second nozzle member is a dovetail groove shape.

10. The gas wiping nozzle according to claim 9, wherein a cross-sectional shape of the shim member is complementary to a shape obtained by combining the dovetail groove shape of the groove portion of the first nozzle member and the dovetail groove shape of the groove portion of the second nozzle member, which are plane-symmetrical with each other.

11. The gas wiping nozzle according to claim 8, wherein a cross-sectional shape of each of the groove portions of the first nozzle member and the second nozzle member is a T-shaped groove shape.

12. The gas wiping nozzle according to claim 11, wherein a cross-sectional shape of the shim member is complementary to an I-shaped groove shape obtained by combining the T-shaped groove shape of the groove portion of the first nozzle member and the T-shaped groove shape of the groove portion of the second nozzle member, which are plane-symmetrical with each other.

13. The gas wiping nozzle according to claim 1, wherein a pin connects the groove portion of the first nozzle member and the shim member, and connects the groove portion of the second nozzle member and the shim member.

14. The gas wiping nozzle according to claim 1, wherein the shim member is attachable to and detachable from each of the groove portions of the first nozzle member and the second nozzle member in a direction parallel to a direction where each of the groove portions of the first nozzle member and the second nozzle member extends.

* * * * *